US006068467A

United States Patent [19]

Mandai et al.

[11] Patent Number: 6,068,467

[45] Date of Patent: May 30, 2000

[54] COMBUSTOR

[75] Inventors: Shigemi Mandai; Koichi Nishida; Masataka Ota; Satoshi Tanimura; Kotaro Miyauchi; Mitsuru Inada; Shinji Akamatsu; Hideki Haruta, all of Takasago, Japan

[73] Assignee: Mitsubishi Heavy Industries, Ltd., Tokyo, Japan

[21] Appl. No.: 09/244,031

[22] Filed: Feb. 4, 1999

[30] Foreign Application Priority Data

Feb. 9, 1998 [JP] Japan ..... 10-027050
Feb. 26, 1998 [JP] Japan ..... 10-045480

[51] Int. Cl.[7] ..... F23C 5/00

[52] U.S. Cl. ..... 431/174; 431/284; 431/285

[58] Field of Search ..... 431/174, 177, 431/278, 284, 285

[56] References Cited

U.S. PATENT DOCUMENTS

| | | | |
|---|---|---|---|
| 2,824,603 | 2/1958 | Reed . | |
| 3,033,273 | 5/1962 | Zink et al. | 431/285 |
| 5,345,768 | 9/1994 | Washam et al. . | |
| 5,558,515 | 9/1996 | Althaus et al. | 431/278 |

FOREIGN PATENT DOCUMENTS

| | | |
|---|---|---|
| 0526152A1 | 7/1992 | European Pat. Off. . |
| 0594127A1 | 4/1994 | European Pat. Off. . |
| 0935095A2 | 8/1999 | European Pat. Off. . |
| 83/04295 | 12/1983 | WIPO . |
| 98/40670 | 9/1998 | WIPO . |

*Primary Examiner*—Carroll Dority
*Attorney, Agent, or Firm*—Weneroth, Lind & Ponack, L.L.P.

[57] ABSTRACT

A combustor has a pilot nozzle 02 arranged at a central portion of an inner cylinder 01 opening at its end into a combustion chamber 018 and includes a plurality of main nozzles 03 arranged around its outer circumference. Along the outer circumference of a flame holding cone 014 for igniting a fuel F injected from the main nozzles 03 there are disposed elliptical extension pipes 016 of an elliptical sectional shape which are extended from the fronts of the main nozzles 03 to have openings at the axial position of the opening of the flame holding cone 014. As a result, a hot premixed flame 013 does not flow back to a main swirler zone 015 of the circumferential edges of the openings of the main nozzles 03 so that mixing between the fuel F and an air flow A can be improved, reducing the Nox emission while eliminating the burning of a base plate 04 and the main nozzles 03.

4 Claims, 7 Drawing Sheets

COMBUSTOR

BACKGROUND OF THE INVENTION

1. Field of the Invention

The present invention relates to a combustor suitable for application to a gas turbine which is enabled to run according to a load by holding a flame inside of a flame holding cone disposed in an inner cylinder that opens at its leading end into a combustion chamber and by igniting and extinguishing a plurality of main nozzles to be activated and deactivated according to the load, thereby changing the number of active main nozzles.

2. Related Art

In the prior art, there has been used a gas turbine having a combustor which is able to run according to a load by providing a pilot nozzle arranged at the central portion of an inner cylinder that opens at its end into a combustion chamber and has a flame holding cone that opens at its leading end portion into the front of the inner cylinder and by providing a plurality of main nozzles adjacent to each other around the outer circumference of the pilot nozzle so that any or all of the main nozzles may be activated according to fluctuations in the load.

In a gas turbine to be used for generating electric power, for example, any or all of the main nozzles are deactivated in the night (this time having a lower power demand). The main nozzles in a number corresponding to a load, are ignited with a flame started and ignited in a flame holding cone in the day time (having a greater power demand) so that the gas turbine may be operated to match the load.

FIG. 6 shows a construction of a combustor to be used in such gas turbine of the prior art.

As shown in FIG. 6, a pilot nozzle 02 is arranged on the axis of an inner cylinder 01, having a cylindrical shape, which is fixed at its rear end portion on a partition 011. Around the outer circumference of the pilot nozzle 02, there are arranged generally in parallel with the pilot nozzle 02 eight main nozzles 03 which are arranged at an equal circumferential pitch and which are likewise fixed at their rear end portions on the partition 011.

In the inner cylinder 01, on the other hand, there is mounted across the inner cylinder 01 a base plate 04 which is provided with through holes 05 for admitting a fuel F fed from the pilot nozzle 02 and the main nozzles 03, an air flow A for preparing a mixture M by mixing it with the fuel F, and a cooling air flow A. The partition 011, the inner cylinder 01 and the base plate 04 construct a wind box 06 around the pilot nozzle 02 and the main nozzles 03.

In front of the pilot nozzle 02, moreover, there is disposed a flame holding cone 014 which is fixed at its rear end portion on the base plate 04 and which is extended forward from the base plate 04 in a frusto-conical shape having a diverging front. The flame holding cone 014 is open at the front of the inner cylinder 01 so that the mixture M of the fuel F having passed the through holes 05 and the air flow A may be ignited to establish a later-described premixed flame 013 therein ahead of the inner cylinder 01 and in a combustion chamber 018.

Around the individual outer circumferences of the pilot nozzle 02 and each main nozzle 03, on the other hand, there are disposed a pilot nozzle outer cylinder 09 and a main nozzle outer cylinder 010 which individually open at their leading ends to communicate with the through holes 05 of the base plate 04. They are provided, on the insides of their rear ends, with a pilot swirler 07 and a main swirler 08 for swirling the air flow A introduced into the wind box 06.

In a combustor 012 for the gas turbine of the prior art thus constructed, the fuel F, as fed forward the base plate 04 from the pilot nozzle 02, is mixed with the swirling flow of the air flow A, which is introduced from the wind box 06 and swirled by the pilot swirler 07 so that it is fed through the inside of the pilot nozzle outer cylinder 09 to the front of the base plate 04, thereby preparing the mixture M. This mixture M is ignited by an igniter (not shown) which is arranged at the back in the flame holding cone 014 so that the premixed flame 013 may be held at all times at a position extending from the inside of the inner cylinder 01 ahead of the flame holding cone 014 to the inside of the combustion chamber 018.

On the other hand, the fuel F, as fed from the main nozzles 03 to the front of the base plate 04, is mixed with the swirling flow of the air flow A, which is likewise introduced from the wind box 06 and swirled by the main swirler 08 and which is fed through the inside of the main nozzles' outer cylinder 010 to the front of the base plate 04, thereby preparing the mixture M. This mixture M is ignited with the aforementioned premixed flame 013 so that the main nozzles 03 are activated to generate a combustion gas G of higher energy to generate a driving force.

In the combustor 012 used in the gas turbine of the prior art, however, a stagnation or back flow may occur in the so-called "main swirler zone 015" between the base plate 04 and the opening of the main nozzles outer cylinder 010 opened ahead of and adjacent to the base plate 04. In this case, with the main nozzles 03 being active, the premixed flame 013, which is generated inside of the inner cylinder 01 ahead of the flame holding cone 014, may propagate to the main swirler zone 015 to ignite the mixture M which has flowed to the main swirler zone 015 around the opening of the main nozzle outer cylinder 010, thereby forming the hot premixed flame 013 just ahead of the base plate 04.

Although only one main swirler zone 015 is shown in FIG. 6 so as to avoid complexity of illustration, it may be formed around any of the openings of the main nozzles outer cylinders 010 of the main nozzles 03 in the active state.

As a result, the formation of the premixed flame ahead of the base plate 04 is especially prominent when the eight main nozzles 03 are active, that is, when the combustor 012 of the gas turbine acts in full load.

The hot premixed flame 013 to be formed as the premixed flame 013 moves forward of the base plate 04 and which is formed just ahead of the base plate 04, namely, at the so-called "main swirler zone 015", will burn the main nozzles 03 and the base plate 04 to seriously to shorten the lifetime of the combustor 012.

Next, FIG. 7 shows an example of a main nozzle of the prior art which is arranged around the outer circumference of the pilot nozzle.

In the wall face of the main nozzle 03 of FIG. 7(*b*) downstream of the position of the main swirler 08 there are formed a plurality of or four fuel nozzle ports 025 for preparing the mixture M by injecting the fuel F into the air flow A which has entered the main nozzle outer cylinder 010 from the wind box 06 and been swirled by the main swirler 08.

In each main nozzle 03, as shown in FIG. 7, the fuel F is injected into the main nozzle outer cylinder 010 from the fuel nozzle ports 025, which is formed in the wall face of the main nozzle 03, and is swirled by the main swirler 08 so that it is mixed to form the mixture M with the air flow A in the main nozzle outer cylinder 010. This mixture M is ignited, as it flows from the main nozzle outer cylinder 010 into the combustion chamber 018, with the premixed flame 013 formed in the pilot nozzle 07 so that the combustion gas G of high energy is generated.

In the case of the main nozzle 03 which is disposed downstream of the main swirler 08 to inject the fuel F from the fuel nozzle ports 025 formed in the wall face of the main nozzle 03, as shown in FIG. 7, however, the mixture M, as prepared in the vicinity of the exit of the main nozzle outer cylinder 010, has a tendency to get a higher concentration of the fuel F at its central portion. In order to achieve a penetration of the fuel F necessary for the fuel to be efficiently mixed with the air flow A which is swirled by the main swirler 08 to flow in the main nozzle outer cylinder 010, moreover, it is necessary to inject the fuel F at a high speed from the fuel nozzle ports 025 into the air flow A in the main nozzle outer cylinder 010. This causes a disadvantage is that the pressure for feeding the fuel F to the inside of the main nozzle 03 has to be set high.

SUMMARY OF THE INVENTION

An object of the invention is to provide a combustor which eliminates such a disadvantage of the combustor of the prior art that its lifetime is shortened by the premixed flame to appear just ahead of the aforementioned base plate, thereby to elongate the lifetime. Even when all the main nozzles are active so that the premixed flame is prominently formed ahead of the base plate to establish a high temperature, therefore, the mixture of the fuel injected from the main nozzle into the combustion chamber and the air flow is ignited downstream of the opening of the flame holding cone by preventing the premixed flame to appear in the inner cylinder ahead of the flame holding cone from propagating to the main swirler zone in the opening ahead of and adjacent to the base plate. Thus, the premixed flame is prevented from being generated ahead of the base plate, thereby to reduce the burning of the main nozzle and the base plate, as might otherwise be caused by the premixed flame.

In order to achieve this object, according to the invention, there is provided a combustor having a structure that a plurality of main nozzles are extended to have openings at the leading end portion of a flame holding cone which is protruded from the front of a pilot nozzle 07 arranged at the central portion of an inner cylinder opened at its leading end into a combustion chamber and having the main nozzles arranged around its outer circumference, for generating a premixed flame therein and ahead of the inner cylinder thereby to ignite a fuel injected from the main nozzles.

In order to extend the openings of the main nozzles to the leading end portion of the flame holding cone in the combustor of the invention, there can be adopted a structure including extension pipes of an appropriate sectional shape, which are protruded along the outer circumference of the flame holding cone from the front of the individual main nozzles to have openings at the leading end portion of the flame holding cone and which are arranged in the circumferential direction of the inner cylinder.

In addition to the constructions thus far described, on the other hand, the combustor of the invention is preferably given a structure in which elliptical extension pipes having their longer axes arranged toward the circumference of the inner cylinder and having a transverse section of an elliptical shape can be adopted as extension pipes protruded from the front of the individual main nozzles and opened at the leading end of the flame holding cone. In addition to this construction, the structure is preferably made such that a porous disc having a number of pores is formed to shut the clearance formed between the circumferential edge of the opening of the flame holding cone and the peripheral edges of the openings of the extension pipes, especially, in case frusta conical cones as the extension pipes, are provided thereby to prevent the premixed flame from propagating from the clearance to the main swirler zone.

Thus in the combustor according to the invention, there are provided the extension pipes in which the openings of the main nozzle are extended to the leading end portion of the flame holding cone, so that the fuel fed from the main nozzles into the combustion chamber is prevented from flowing into the main swirler zone. Even if a stagnation or back flow occurs in the main swirler zone, the premixed flame, as generated at the exit of the flame holding cone, is prevented from propagating upstream so that the base plate mounting the main nozzles and the flame holding cone is prevented from being burned.

In the structure provided with elliptical ones as the extension pipes, on the other hand, the swirling flow of the air flow, as established by the main swirler in the outer cylinder disposed around the main nozzle, is kept and injected from the inner cylinder into the furnace so that the mixing force of the fuel injected from the main nozzles and the air can be enhanced to reduce the NOx emission of the combustion gas G.

In the construction of the combustor of the invention in which the porous disc having the numerous pores is provided for shutting the clearance formed between the opening of the flame holding cone opened in the inner cylinder and the openings of the extension pipes thereby to prevent the premixed flame from propagating from the clearance into the main swirler zone, on the other hand, the premixed flame, as generated at the exit of the flame holding cone, is prevented by the porous disc from flowing back from the clearance between the opening of the flame holding cone and the openings of the extension pipes to the front of the base plate located upstream, so that the hot gas is not generated in the main swirler zone to prevent more reliably the base plate mounting the main nozzles and the flame holding cone from being burned.

Since the porous disc has the pores, moreover, the cooling air flow to spurt through the base plate from the inner cylinder into the furnace can be homogenized to improve the effect to cooling the inner face of the inner cylinder or the like.

Another object of the invention is to solve the aforementioned problem of the main nozzle of the prior art, that is, to eliminate the disadvantage of the main nozzle of the prior art that the mixture having a higher fuel concentration at its center portion is prepared in the vicinity of the exit of the main nozzle outer cylinder, and that the pressure for feeding the fuel to the main nozzle has to be set high. Therefore, the object is to provide a combustor in which the mixture to be fed to the combustion chamber takes a homogenous fuel concentration, even if the fuel under a feed pressure set low is to be mixed with the air, thereby to establish a satisfactory mixed state.

In order to achieve this object, therefore, the combustor of the invention adopts the main nozzle having the following structure.

First of all, an upstream swirler is arranged in an upstream inside of the outer cylinder for swirling the air flow coming from the wind box into the outer cylinder.

This upstream swirler is desirably made of a plate which is circumferential mounted between the outer circumference of the main nozzle and the inner circumference of the outer cylinder and which is sloped with respect to the direction of an air passage formed in the outer cylinder, so as to establish a swirling flow of the air flow coming from the wind box into the outer cylinder.

Here in the wall face of the main nozzle, there are formed fuel nozzle ports which are preferably positioned upstream of the upstream swirler but may be interposed between the upstream swirler and a later-described downstream swirler.

There is further provided the downstream swirler which is arranged inside of the outer cylinder on the downstream side of the position of the upstream swirler for establishing a backward swirling flow to swirl the mixture, which is prepared by mixing the fuel injected from the fuel nozzle ports into the outer cylinder, and the air flow, which is swirled by the upstream swirler, backward of the direction of the swirling flow generated by the upstream swirler.

Like the upstream swirler, the downstream swirler is desirably formed of a plate which is circumferentially mounted between the outer circumference of the main nozzle and the inner circumference of the outer cylinder.

Here, the attack angle of the downstream swirler with respect to the direction of the air passage is reversed from that of the upstream swirler.

Since the main nozzle adopted in the invention has the structure thus far described, the fuel is injected from the fuel nozzle ports into and mixed with the air flow which has been swirled by the upstream swirler in the outer cylinder. The mixture thus prepared by the mixing of the fuel and the air flow is further swirled by the downstream swirler backward of the swirling flow established by the upstream swirler, so that the mixture is sufficiently mixed between the fuel and the air flow. Thus, the fuel, as injected from the fuel nozzle ports into the outer cylinder, is not locally left at the center portion of the mixture to provide a mixture containing a homogeneously distributed fuel, so that the combustion in the combustion chamber can be performed efficiently to reduce the NOx emission of the combustion gas.

Moreover, the injection rate of the fuel to be injected from the fuel nozzle ports, which has to be sufficiently high for giving a fuel penetration to mix the fuel with the air flow efficiently, can be lowered for the efficient mixing of the air flow and the mixture so that the fuel feeding pressure can be lowered.

As a result, the capacity of the combustion compressor can be reduced to lower the cost thereby to reduce the running cost necessary for the combustor.

DESCRIPTION OF THE PREFERRED EMBODIMENTS

One embodiment of a combustor of the invention will be described with reference to the accompanying drawings.

(First Embodiment)

First of all, the first embodiment of the combustor of the invention will be described with reference to FIG. 1.

Figure 1B:
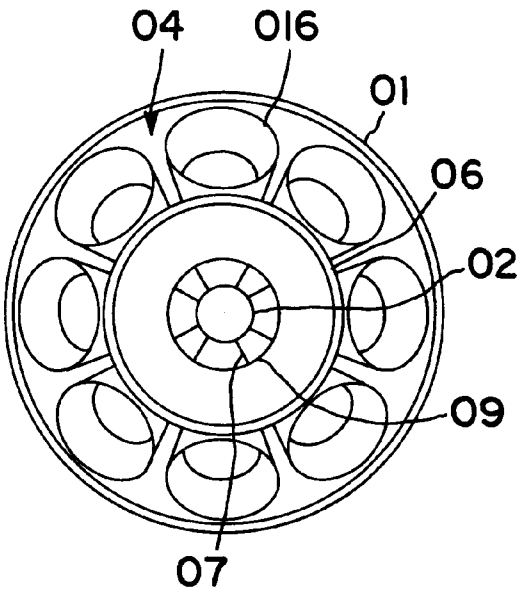
In FIGS. 1(*a*) and 1(*b*) showing a combustor according to a first embodiment of the invention, FIG. 1(*a*) is a longitudinal section, and FIG. 1(*b*) is a front elevation taken along arrows A—A of FIG. 1(*a*)
Figure 1A:
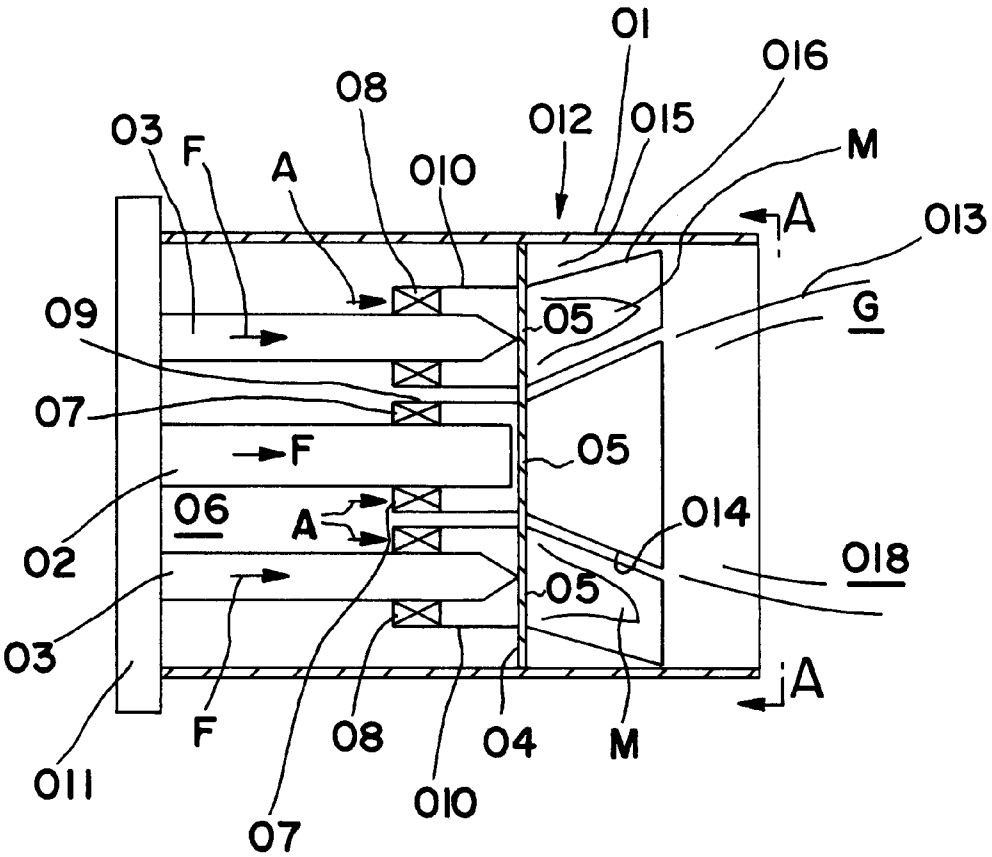
Figure 6B:
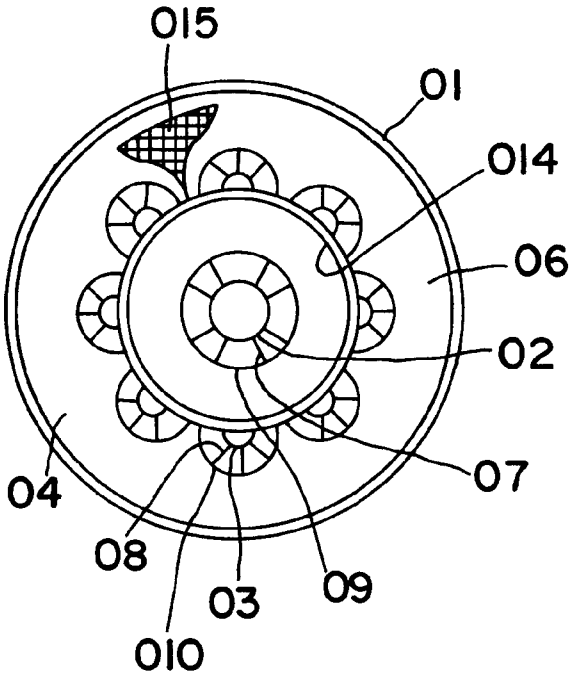
FIG. 6(b) PRIOR ART
In FIGS. 6(*a*) and 6(*b*) showing a construction of a combustor used in a gas turbine of the prior art, FIG. 6(*a*) is a longitudinal section, and FIG. 6(*b*) is a front elevation taken along arrows A—A of FIG. 6(*a*); and In FIGS. 7(*a*) and 7(*b*) showing another example of the main nozzle of the combustor of the prior art, FIG. 7(*a*) is a longitudinal section, and FIG. 7(*b*) is a transverse section taken along arrows A—A of FIG. 7(*a*).
Figure 6A:
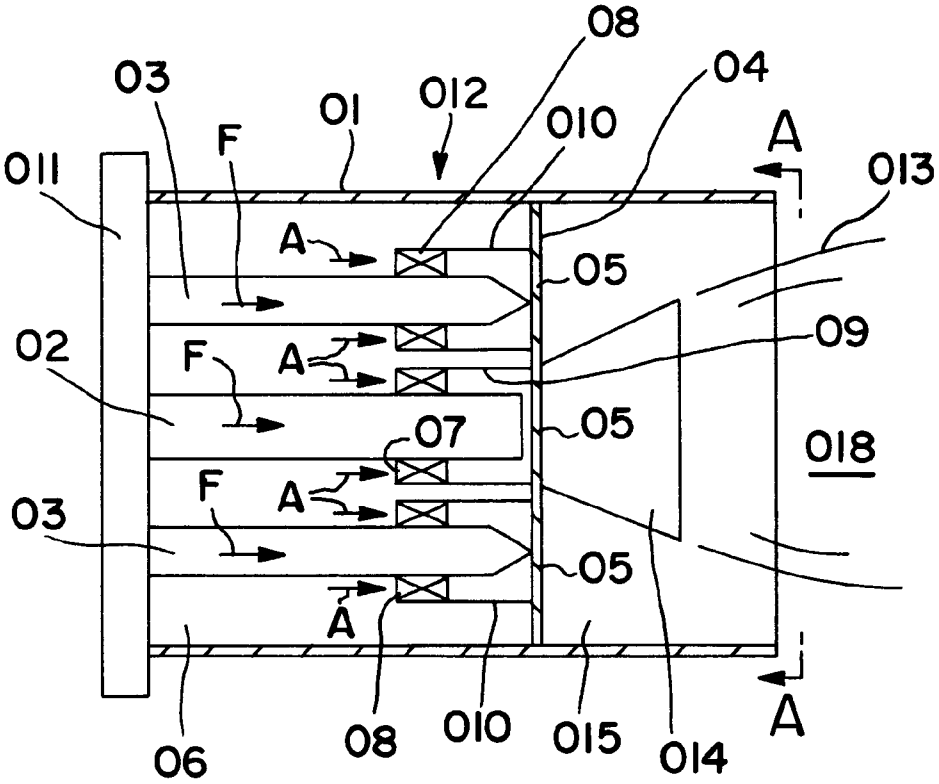
FIG. 6(a) PRIOR ART

In FIG. 1, members identical or similar to those of FIG. 6 are designated by common reference numerals, and their description will be omitted.

As shown in FIGS. 1(*a*) and 1(*b*), a combustor 012 has elliptical extension pipes 016 extending to the front opening of a flame holding cone 014 and communicate with openings at leading end portion of a main nozzle outer cylinders 010.

The elliptical extension pipes 016 are axially extended in the inner cylinder 01 and have openings at substantially the same axial positions as the opening of the flame holding cone 014. These elliptical extension pipes 016 are shaped so that their connection portions to the main nozzle outer cylinder 010, i.e., their rear end portions to be fixed on a base plate 04, are made cylindrical. They are gradually made elliptical so as to have their longer axes arranged in the circumferential direction of the combustor 012. The elliptical extension pipes 016 are further shaped so that their outer peripheral edge portions are in the same plane with the outer circumferential edge of the flame holding cone 014.

Specifically, between the exit of the flame holding cone 014, which is fixed at its rear end portion on the circumferential edge portion of the leading end opening of a pilot nozzle outer cylinder 09 and protrudes forward, and the inner circumference of the inner cylinder 01, there is formed an annulus which has a long circumference and a small width. Therefore, extension pipes ahead of the main nozzle 03 are formed into elliptical extension pipes 016 which are made elliptical so that the annulus may be minimized at the exit portion.

In the combustor 012 of this embodiment, a mixture M is prepared when a fuel F, injected through the main nozzles 03 from a leading end portion, and an air flow A, as introduced from a wind box 06, swirled by a main swirler 08, and injected through the inside of the main nozzle outer cylinder 010 from the leading end portion, are mixed. This mixture M is ignited as it passes from the leading end of the main nozzle outer cylinder 010 through the elliptical extension pipes 016 and flows from the leading end openings into the inner cylinder 01. The flame which is held in the vicinity of the exit of the flame holding cone 014 so that a premixed flame 013 is injected from the opening of the inner cylinder 01 into a combustion chamber 018.

Here, even if a stagnation or back flow is present in the opening of the main nozzle outer cylinder 010, as opened just ahead and adjacent to the base plate 04, and in the so-called main swirler zone 015' which is formed between the main nozzle outer cylinder 010 and the pilot nozzle outer cylinder 09, there is fuel F which passes through the inside of main nozzles 03 and is injected from the main nozzles 03 into the combustion chamber 018. As a result, the premixed flame 013, as generated at the exit of the flame holding cone 014, neither propagates to the main swirler zone 015, nor appears as the hot premixed flame 013 in the main swirler zone 015, so that neither the main nozzles 03 nor the base plate 04 is burned by the premixed flame 013 that might otherwise appear in the main swirler zone 015.

On the other hand, the mixture M, as prepared by the mixing between the fuel F injected from the main nozzles 03 and the air flow A discharged in the swirling flow from the main nozzle outer cylinder 010, retains the swirling force of the main swirler 08 while it is flowing through the elliptical extension pipes 016 to the openings of the elliptical extension pipes 016, in which the mixture M is to be ignited with the flame. As a result, the mixing between the fuel F and the air flow A can be improved to suppress the emission of NOx in a combustion gas G to be discharged from the combustor 012.

(Second Embodiment)

Next, a combustor according to a second embodiment of the invention will be described with reference to FIGS. 2(*a*) and 2(*b*).

Figure 2B:
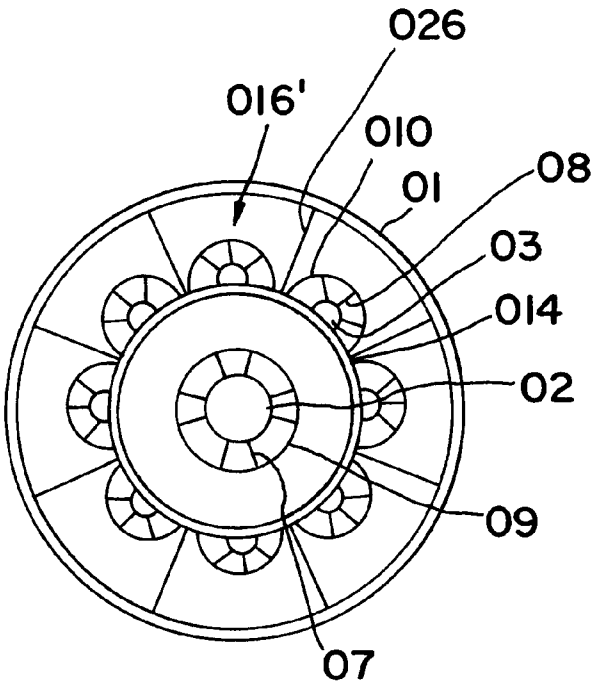
In FIGS. 2(*a*) and FIG. 2(*b*) showing a combustor according to a second embodiment of the invention, FIG. 2(*a*) is a longitudinal section, and FIG. 2(*b*) is a front elevation taken along arrows A—A of FIG. 2(*a*)
Figure 2A:
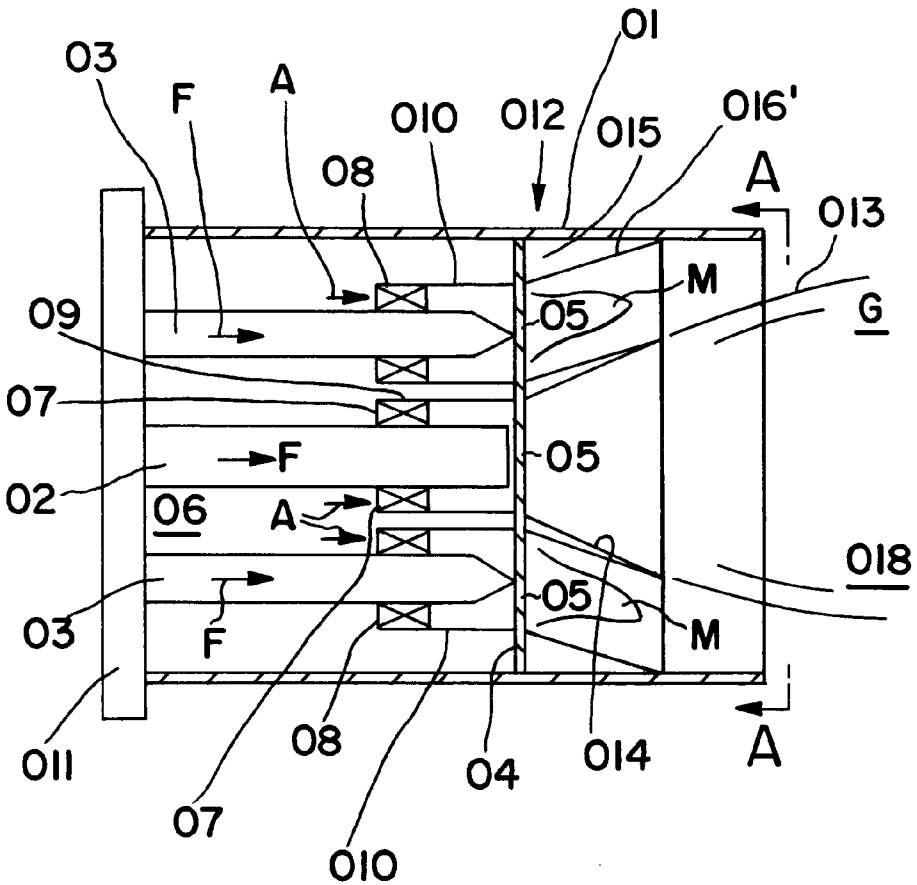

In the combustor 012 of this embodiment, as shown in FIGS. 2(*a*) and 2(*b*) the extension pipes, which are extended to the position of the front opening of the flame holding cone 014 while communicating with the openings of the leading end portions of the main nozzle outer cylinders 010, replace the elliptical extension pipes 016 according to the first embodiment, by an annular extension pipe 016. The pipe 016' has an annular opening by making its inner circumference that of the outer circumference that of the opening of the leading end portion of the flame holding cone 014 and its outer circumference of the inner circumference of the inner cylinder 01.

This annular extension pipe 0161 is formed, at its joint to the main nozzle outer cylinder 010, into a cylindrical shape as in the aforementioned elliptical extension pipes 016, and is gradually deformed downward from the cylindrical shape so as to form sector openings which are divided by partitions 026 partitioning the annulus according to the number of the main nozzles 03.

As compared with the elliptical extension pipe 016 of the first embodiment, the annular extension pipe 016' of this embodiment is formed into the cylindrical shape at its joint portion to the base plate 04 and into the sector shape at its opening. As a result, the operation and effect to be obtained from the annular extension pipe 016' of this embodiment are similar to those of the elliptical extension pipes 016. There arise disadvantages in, a requirement for a high grade making technique for working the deformation, leading to the opens of sector shapes, a working strength at the corners of the openings and homogeneity of the mixture M at the corners.

When the extension pipe or pipes are to be provided, no matter whether they might be exemplified by the elliptical extension pipes 016 or the annular extension pipe 016', on the other hand, it is important that the working at the opening be easy and that the workability of the opening be excellent when numerous extension pipes are to be provided. In this respect, the annular extension pipe 016' is superior to the elliptical extension pipes 016 because it hardly requires working at the opening.

In the construction provided with the annular extension pipe 016', moreover, the clearance to be formed between the outer circumference of the opening of the flame holding cone 014 and the inner circumference of the inner cylinder 01 can be sufficiently reduced although it can also be reduced a little in the elliptical extension pipes 016. As a result, the occurrence of the premixed flame 013 in the main swirler zone 015 can be more greatly reduced to reliably prevent the burning of the main nozzles 03 and the base plate 04.

(Third Embodiment)

A combustor according to a third embodiment of the invention will be described with reference to FIGS. 3(*a*) and 3(*b*).

Figure 3B:
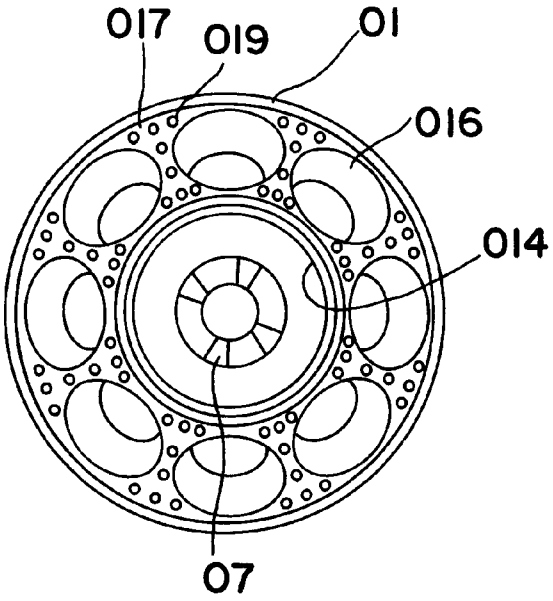
In FIGS. 3(*a*) and 3(*b*) showing a combustor according to a third embodiment of the invention, FIG. 3(*a*) is a longitudinal section, and FIG. 3(*b*) is a front elevation taken along arrows A—A of FIG. 3(*a*)
Figure 3A:
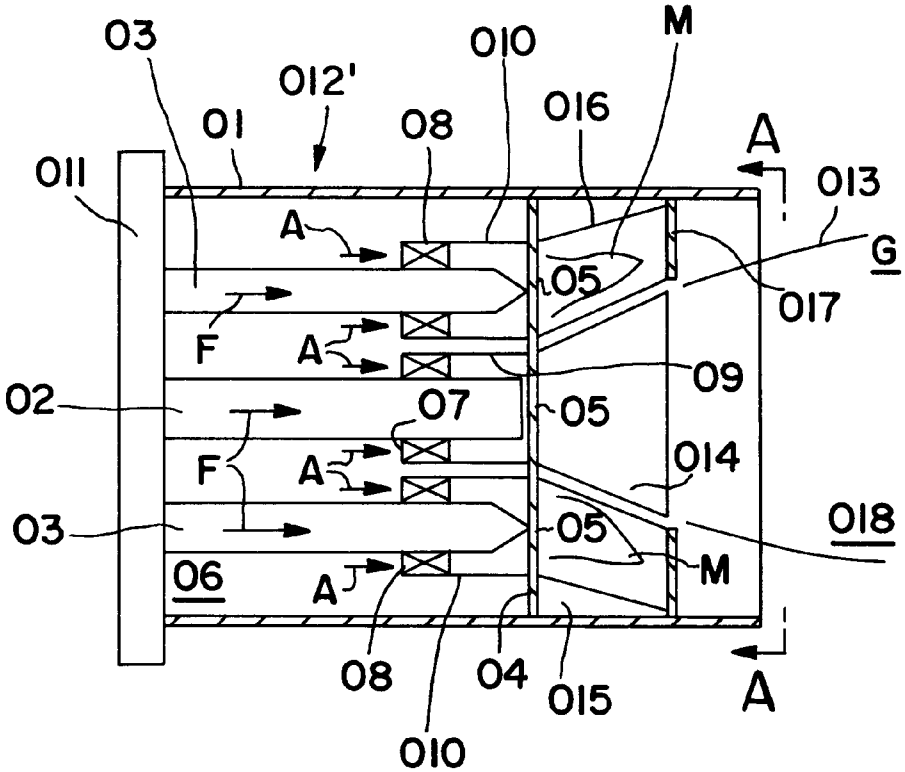

In a combustor 012 of this embodiment, as shown in FIGS. 3(*a*) and 3(*b*), a clearance between the opening of the flame holding cone 014 shown in FIG. 1 and the openings of the elliptical extension pipes 016 is shut with a porous disc 017.

In this porous disc 017, there are formed a number of pores 019 for preventing the space, which is formed between the outer circumferences of the flame holding cone 014 and the elliptical extension pipes 016, from being shut at its front, downstream side.

Specifically, the cooling air flow A spurting directly from the inside of the wind box 06 into the inner cylinder 010 ahead of the base plate 04 is allowed to flow smoothly through the porous disc 017 and homogenized in the inner cylinder 01.

Moreover, the porous disc 017 is mounted and fixed in the inner cylinder 01 by welding its outer circumferential edge to the inner face of the inner cylinder 01 and likewise to the circumferential edge of the opening of the flame holding cone 014 and the peripheral edges of the openings of the elliptical extension pipes 016.

In the combustor 012 of this embodiment, as described hereinbefore, the clearance between the openings of the elliptical extension pipes 016 at the leading opening of the main nozzle outer cylinder 010 and the opening of the flame holding cone 014 is shut with the porous disc 017 so that it is not sealed because the numerous pores 019 are formed through the porous disc 017. As a result, the hot gas, as produced ahead of the openings of the elliptical extension pipes 016 and the opening of the flame holding cone 014, is prevented by the porous disc 017 and the cooling air flow A spurting at a high speed from the pores 019 of the porous disc 017 from flowing backward from that clearance into the space which is formed between the outer circumferences of the flame holding cone 014 ahead of the base plate 04 and the elliptical extension pipes 016.

As a result, the hot premixed flame 013 is less generated in the main swirler zone to more reliably prevent the outer circumferences of the flame holding cone 014 or the elliptical extension pipes 016 or the front face of the base plate 04 from being exposed to the hot gas, so that the main nozzles 03 and the base plate 04 are less burned.

Since the numerous pores 019 are formed in the porous disc 017, on the other hand, the space to be formed between the outer circumferences of the flame holding cone 014 ahead of the base plate 04 and the elliptical extension pipes 016 is not sealed. As a result, the cooling air flowing through the base plate 04 and the inside of the inner cylinder 01 and spurting into the combustion chamber 018 is homogenized to effectively cool the inner face of the inner cylinder 01, the outer faces of the main nozzles 03 and the pilot nozzle 02, and the outer circumferences of the flame holding cone 014 and the elliptical extension pipes 016.

(Fourth Embodiment)

A fourth embodiment of the invention will be described with reference to FIGS. 4(*a*) and 4(*b*).

Figure 7A:
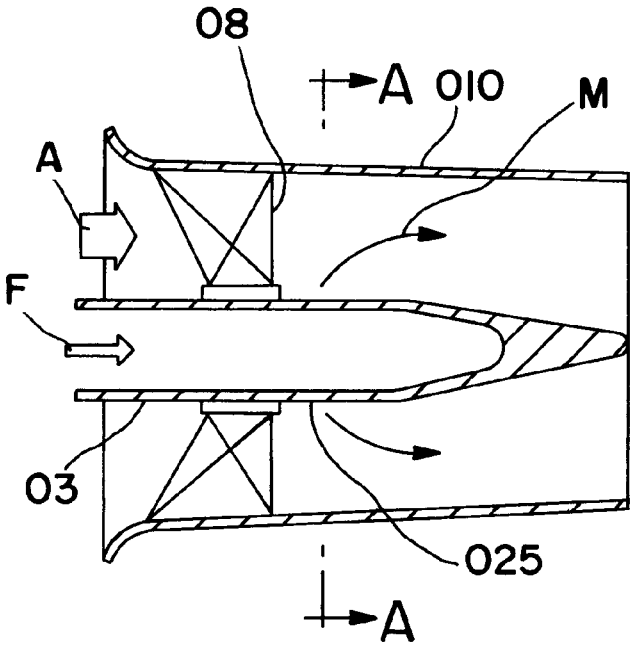
FIG. 7(a) PRIOR ART
Figure 7B:
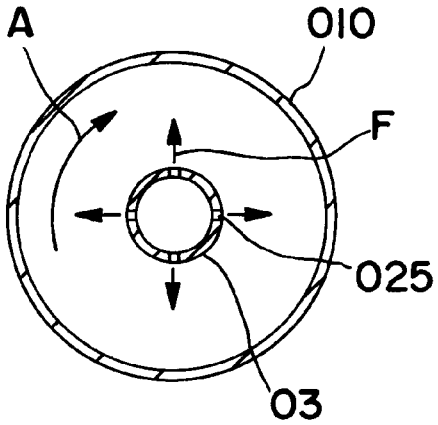
FIG. 7(b) PRIOR ART

Here, members identical or similar to those of FIG. 7 are designated by common reference numerals, and their description will be minimized.

Figure 4A:
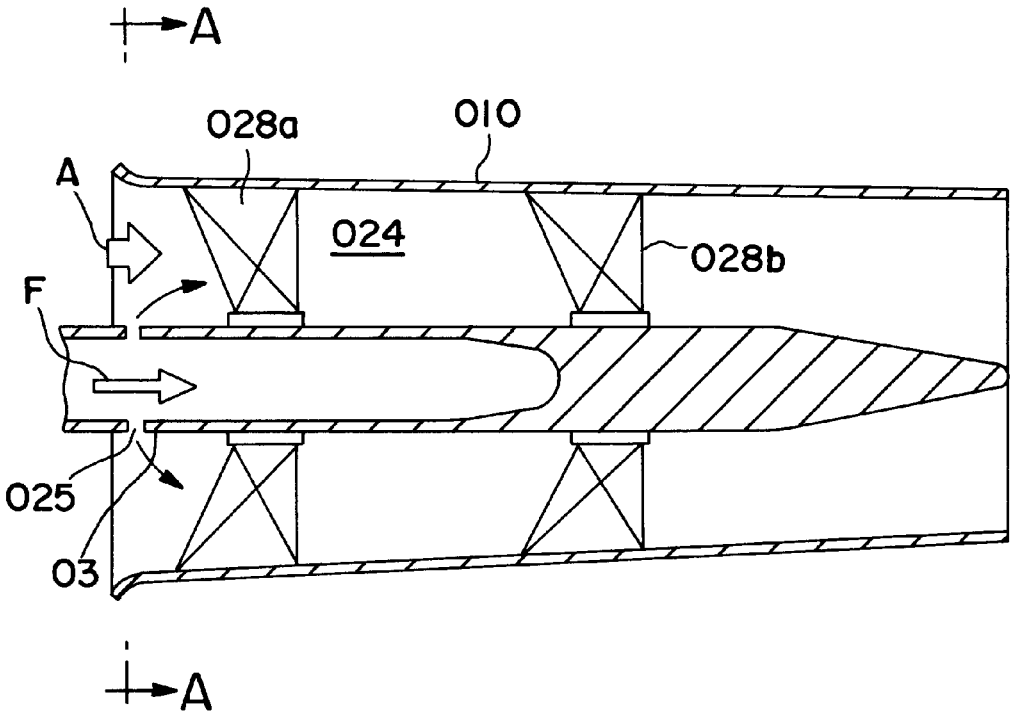
In FIGS. 4(*a*) and 4(*b*) showing a main nozzle of the combustor according to a fourth embodiment of the invention, FIGS. 4(*a*) is a longitudinal section, and FIG. 4(*b*) is a transverse section taken along arrows A—A of FIG. 4(*a*)
Figure 4B:
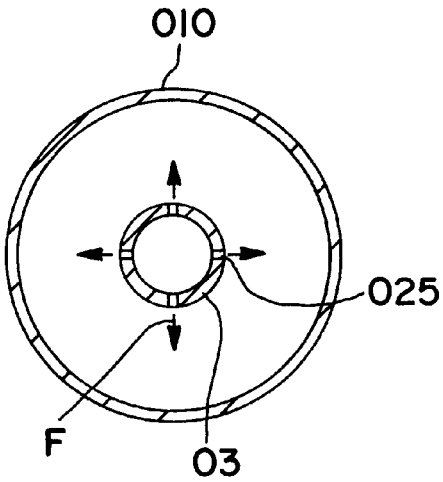

As shown in FIGS. 4(*a*) and 4(*b*), the main nozzles 03 in the combustor of this embodiment are constructed such that the main swirler to be arranged around the main nozzles 03 is divided into two. Specifically, there are arranged, in tandem and at a suitable spacing in the axial direction of the main nozzles 03, an upstream main swirler 028*a* as an upstream swirler arranged at the rear end portion or on the upstream side of the main nozzle outer cylinder 010, and a downstream main swirler 028*b* as a downstream swirler arranged at a front end portion or on the downstream side of the main nozzle outer cylinder 010.

The upstream main swirler 028*a* and the downstream main swirler 028*b* reverse the swirling directions of the swirling flow to be established in the air flow A which flows in an air passage 024 formed between the outer circumferences of the main nozzles 03 and the inner circumference of the main nozzle outer cylinder 010.

Specifically, the upstream main swirler 028*a* is made of a plate which is sloped with respect to the direction of the air passage 024 formed in the main nozzle outer cylinder 010 so that a clockwise swirling flow may be established when the air flow A flowing from the wind box 06 into the main nozzle outer cylinder 010 passes therethrough. Then, the plate member constructing the downstream main swirler 028*b* is sloped with respect to the direction of the air passage 024 so that a counterclockwise air flow, reverse to that of the upstream main swirler 028*a,* can be established in the air flow A.

On the other hand, four fuel nozzle ports 025, for example, which are formed vertically or horizontally through the walls of the main nozzles 03 so as to inject the fuel F from the main nozzles 03 into the air passage 024, are opened upstream of the upstream main swirler 028*a*.

Here, the fuel nozzle ports 025 may also be opened between the upstream main swirler 028*a* and the downstream main swirler 028*b*. With this arrangement of the fuel nozzle ports 025, however, it is predicted that the homogenization of the concentration is slightly worse than that of the aforementioned case in which the fuel nozzle ports 025 are formed upstream of the upstream main swirler 028*a*, so that the mixing section can be elongated by preparing the mixture M and by passing it through the upstream main swirler 028*a* to thereby ensure a more homogenized concentration.

As a result, the fuel F, as injected from the fuel nozzle ports 025 into the air passage 024, flows while being mixed with the air flow A which has passed the upstream main swirler 028*a* and flows in a clockwise swirling flow, for example, through the air passage 024, so that the mixture M flows into the downstream main swirler 028*b*.

Moreover, the mixture M having flowed into the downstream main swirler 028*b* is given the counter-clockwise swirling force while passing through the downstream main swirler 028*b* so that more homogenized mixture M flows from the air passage 024 into the combustion chamber 018 shown in FIGS. 1(*a*) to 3(*b*).

Thus, although only one main swirler 08 is disposed in each main nozzle 03 in the prior art, in the main nozzles 03 in the combustor of this embodiment, the upstream main swirler 028*a* and the downstream main swirler 028*b* are individually arranged on the upstream and downstream sides of the fuel nozzle ports 025 and are given the reverse swirling directions.

As a result, the fuel F, as injected from the fuel nozzle ports 025 to the upstream side of the upstream main swirler 028*a,* is mixed with the air flow A which has passed the upstream main swirler 028*a* and flows downstream in the air passage 024 while swirling in one direction, and further flows through the downstream main swirler 028*b* for establishing the swirling flow in the other direction, so that the mixture M spurting into the A combusion chamber 018 from the exit of the main nozzle outer cylinder 010 is homogenized in fuel concentration distribution.

As a result, this homogeneous mixture M can be ignited with the diffusion flame, which is held in front of the pilot nozzle 02, to suppress the amount of NOx to be generated in the combustion gas G in the combustion chamber 018.

On the other hand, the main nozzles 03 of the prior art require a high fuel feed pressure so as to establish the homogenous mixture M at the exit of the main nozzle outer cylinder 010. In this embodiment, however, the fuel F is fed upstream of the upstream main swirler 028*a* so that the fuel F injected from the fuel nozzle ports 025 and the air flow A in the main nozzle outer cylinder 010 are forcibly mixed by the swirling forces in the two reverse directions. As a result, a satisfactory mixed state can be established even under a low fuel feed pressure.

(Fifth Embodiment)

Next, a fifth embodiment of the invention will be described with reference to FIG. 5.

Figure 5:
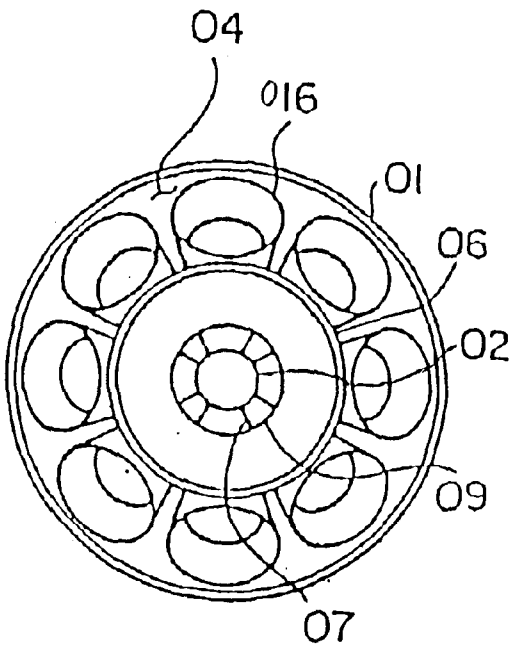
In FIGS. 5(*a*) and 5(*b*) showing a main nozzle of the combustor according to a fifth embodiment of the invention, FIG. 5(*a*) is a longitudinal section, and FIG. 5(*b*) is a transverse section taken along arrows A—A of FIG. 5(*a*)
Figure 5:
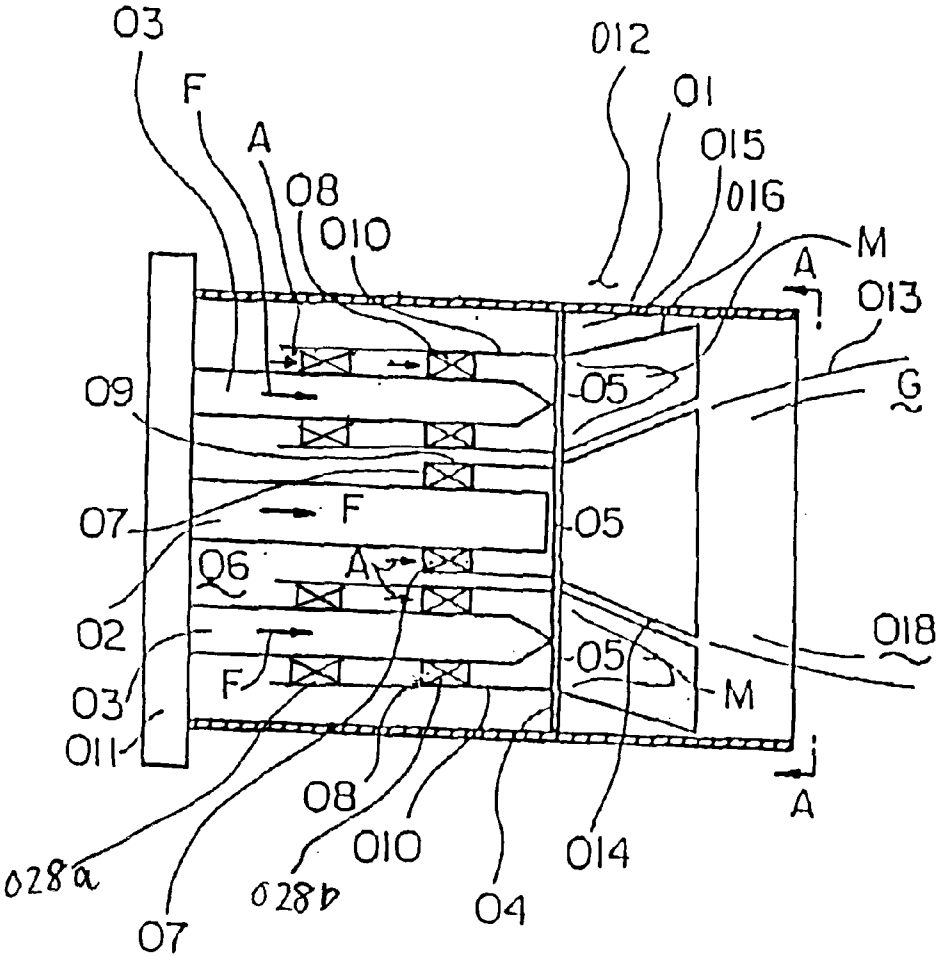

In the construction of the main nozzles 03 of the combustor of this embodiment, as shown in FIG. 5, the elliptical extension pipes 016 are extended to the position of the front opening of the flame holding cone 014, as in the combustor 012 of the first embodiment shown in FIG. 1, while communicating with the opening of the leading end portion of the main nozzle outer cylinder 010. As in the combustor 012 of the fourth embodiment shown in FIG. 4, moreover, the main swirler 08, which is disposed in each of the main nozzles 03 arranged around the flame holding cone 014, is composed of the upstream main swirler 028*a* and the downstream main swirler 028*b*.

As a result, not only operations and effects similar to those of the main nozzles 03 having the elliptical extension pipes 016 of the foregoing first embodiment, but also operations and effects similar to those of the main nozzles 03 having the upstream main swirlers 028*a* and the downstream main swirlers 028*b* of the foregoing fourth embodiment can be achieved, so that multiplied operations and effects of the two embodiments can be achieved.

What is claimed is:

1. A combustor comprising:

an inner cylinder having a front end opening into a combustion chamber;

a pilot nozzle at a central portion of said inner cylinder;

a plurality of main nozzles arranged circumferentially around said pilot nozzle, said plurality of main nozzles having respective openings;

a flame holding cone extending from the front of said pilot nozzle, said flame holding cone having a leading end portion with an opening inside of said front end of said inner cylinder whereby a premixed flame can be formed by generating a flame ahead of said flame holding cone from inside of said inner cylinder for igniting fuel from said plurality of main nozzles; and extension pipes extending from said openings of said plurality of main nozzles to said opening of said leading end portion of said flame holding cone;

wherein said extension pipes extend from said main nozzles along the outer circumference of said flame holding cone to respective openings located at the axial position of said opening of said leading end portion of said flame holding cone, said openings of said extension pipes having elliptical sectional shapes having longer axes arranged in the circumferential direction of said inner cylinder.

2. The combustor of claim 1, and further comprising a porous disc having a plurality of pores therein, said disc being disposed between and sealing a clearance between said inner cylinder, said opening of said leading end portion of said flame holding cone and said openings of said extension pipes.

3. The combustor of claim 1, wherein each main nozzle of said plurality of main nozzles has fuel nozzle ports therein and includes:

an outer cylinder surrounding said main nozzle with a clearance, said outer cylinder having an upstream side and a downstream side;

an upstream swirler disposed on said upstream side of said outer cylinder for establishing a swirling air flow in said outer cylinder; and a downstream swirler disposed on said downstream side of said outer cylinder for establishing a swirling air flow in a direction reverse to the direction of said upstream swirler, whereby air entering said outer cylinder can be mixed with fuel from said fuel nozzle ports.

4. A combustor comprising:

an inner cylinder having a front end opening into a combustion chamber;

a pilot nozzle at a central portion of said inner cylinder;

a plurality of main nozzles arranged circumferentially around said pilot nozzle, said plurality of main nozzles having respective openings; and a flame holding cone extending from the front of said pilot nozzle, said flame holding cone having a leading end portion with an opening inside of said front end of said inner cylinder whereby a premixed flame can be formed by generating a flame ahead of said flame holding cone from inside of said inner cylinder for igniting fuel from said plurality of main nozzles;

wherein each main nozzle of said plurality of main nozzles has fuel nozzle ports therein and includes:

an outer cylinder surrounding said main nozzle with a clearance, said outer cylinder having an upstream side and a downstream side, an upstream swirler disposed on said upstream side of said outer cylinder for establishing a swirling air flow in said outer cylinder, and a downstream swirler disposed on said downstream side of said outer cylinder for establishing a swirling air flow in a direction reverse to the direction of said upstream swirler, whereby air entering said outer cylinder can be mixed with fuel from said fuel nozzle ports.

* * * * *